United States Patent [19]

Tochihara

[11] 4,177,612

[45] Dec. 11, 1979

[54] BEAUTY OPERATOR WALL STRUCTURE

[76] Inventor: Joe I. Tochihara, 4586 Everest Cir., Cypress, Calif. 90630

[21] Appl. No.: 925,221

[22] Filed: Jul. 17, 1978

[51] Int. Cl.[2] ..... E04H 3/00

[52] U.S. Cl. ..... 52/28; 52/36; 52/238

[58] Field of Search ..... 52/28, 34, 36, 238

[56] References Cited

U.S. PATENT DOCUMENTS

| | | | |
|---|---|---|---|
| 1,534,644 | 4/1925 | Howard | 52/33 |
| 3,083,417 | 4/1963 | Cook | 52/238 X |
| 3,406,491 | 10/1968 | Harding | 52/238 |
| 3,462,892 | 8/1969 | Meyer | 52/28 |
| 3,769,502 | 9/1973 | Schultz et al. | 52/28 |
| 3,921,345 | 11/1975 | Damico | 52/28 |
| 3,945,132 | 3/1976 | Parmelee | 52/36 |
| 4,118,903 | 10/1978 | Coulthard | 52/36 |

FOREIGN PATENT DOCUMENTS

| | | | |
|---|---|---|---|
| 1418500 | 12/1975 | United Kingdom | 52/36 |

*Primary Examiner*—J. Karl Bell

*Attorney, Agent, or Firm*—William C. Babcock

[57] ABSTRACT

A prefabricated wall structure that is used in pairs to define a confined space therebetween in which a beauty operator may perform work on a patron, with each of the wall structures capable of being removably secured to a vertical and horizontal structural member that are in turn affixed to a wall and floor of a building in which the business of a beauty salon is carried out. Each wall structure includes a first mirror, lighting means, and numerous drawer means to removably hold all the accessories a beauty operator may need, and also wells in which bottles of liquids such as lotions and the like that may be needed by the operator. When the accessories are not in use they are held in concealed positions within the wall structure. The pair of wall structures have a mirror extending therebetween and preferably at least partially support the same, with the mirror adjacently disposed to the portion of the wall of the building most adjacent the pair of wall structures. Numerous pairs of the wall structures may be disposed within a building to define confined spaces for beauty operators therebetween.

1 Claim, 4 Drawing Figures

FIG. 1
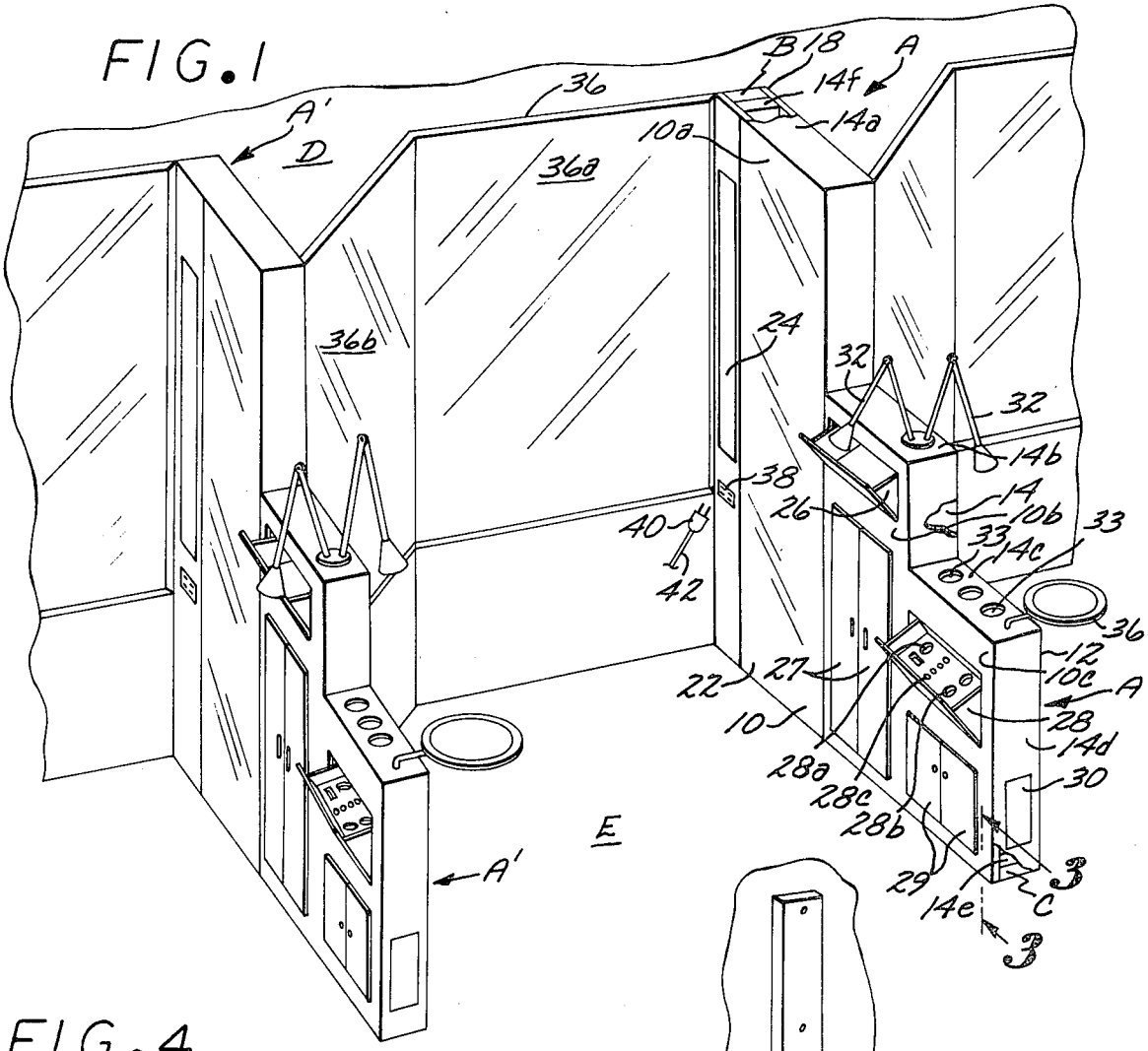
FIG. 4
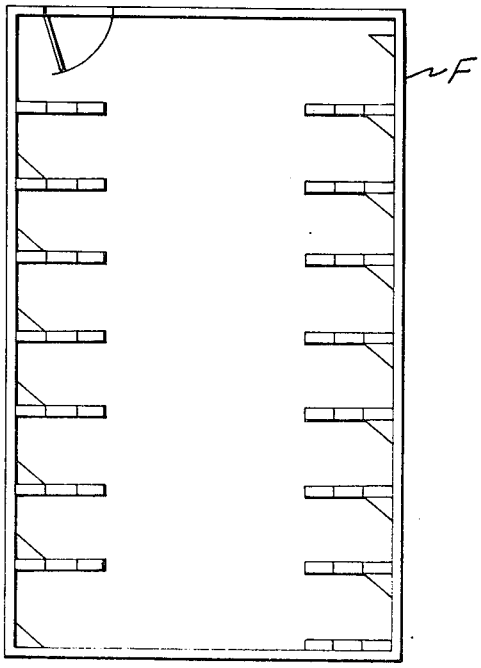
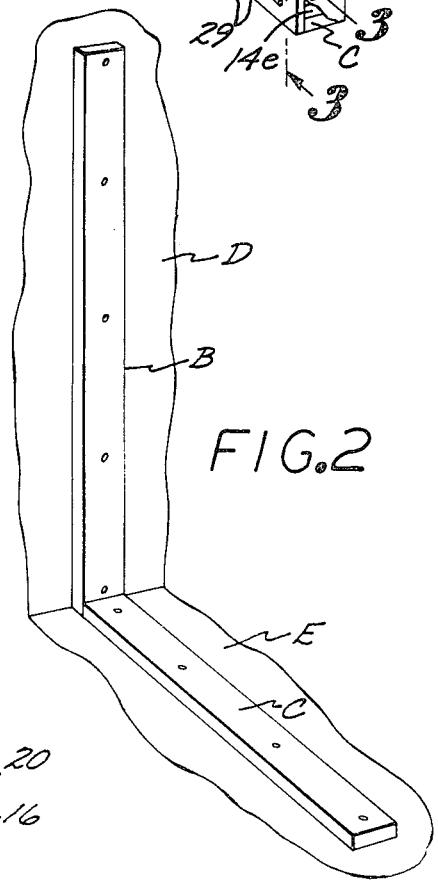
FIG. 2
FIG. 3
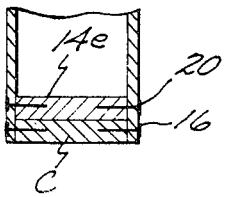

BEAUTY OPERATOR WALL STRUCTURE

BACKGROUND OF THE INVENTION

1. Field of the Invention

Beauty Operator Wall Structure.

2. Description of the Prior Art

Beauty salons are most frequently set up and conducted as a business in rented buildings. The cost of converting a rented building to a beauty salon is substantial, and due to the remodeling of the building to a beauty salon involving the securing of partitions and the like to the building, these fixtures or improvements cannot be removed when the operator terminates his lease or desires to move to another location. The expense of such remodeling is normally very substantial, and in the past there has been no means of minimizing the same, and still having a beauty salon that is unique and attractive in appearance.

A major object of the present invention is to provide a number of prefabricated wall structures that may be arranged in pairs within a building, and each pair of the wall structures defining a confined space therebetween in which the chair for a patron is disposed, and the confined space still allowing sufficient room for a beauty operator to move around the patron as he performs work on the latter. The wall structures, when arranged in pairs, may be disposed side-by-side to accommodate any desired number of beauty operators within a room or a building. Each of the wall structures has a vertically and horizontally extending recess defined therein which is adapted to removably engage a vertical structural member and a horizontal structural member secured to a wall and the floor of the building. Each wall structure contains all of the necessary accessories needed by a beauty operator in performing hair dressing and the like. When it is desired to move the beauty salon from the building, the prefabricated wall structures are simply disengaged from the previously mentioned vertical and horizontal structural members and moved to a new location. Each of the wall structures is of such design that it not only supports lighting means, a mirror, but numerous drawers in which beauty operators supplies and accessories are maintained in a concealed condition until the beauty operator requires the use of them.

Another object of the invention is to supply a wall structure that is not only simple and easy to install in a fixed position within a building, but one that lends a unique and ornamental appearance to the beauty salon, as well as so maintaining the accessories of the beauty operator that the same are easily accessible and may be removed from a place in the appropriate storage space in the wall structure with a minimum of effort and inconvenience.

The wall structure serves to substantially eliminate the possibility of an electric shock to the patron, due to the wiring being completely concealed within the interior thereof and not being contactable by either the operator or patron.

SUMMARY OF THE INVENTION

The prefabricated wall structure is used in pairs that define a confined space therebetween in a building that has a floor and walls extending upwardly therefrom. Vertical and horizontal structural members are secured to the wall and floor to lie in the same vertical plane, but spaced from one another. Each of the wall structures of the present invention is removably secured to one of the vertical structural members and horizontal structural member associated therewith. The wall structures when so supported within the building define a confined space therebetween.

Each of the wall structures includes first and second laterally spaced, parallel, side walls with each of the side walls defining first, second and third rectangular panels of decreasing height.

A hollow frame assembly is provided that is disposed between the first and second side walls, and rigidly secured thereto with the frame assembly defining first, second and third horizontal surfaces that are flush with the horizontal surfaces of the first, second and third panels. The frame assembly also defines a forward vertical surface flush with the forward vertical edges of the first and second side walls, as well as a horizontal portion upwardly disposed from the lower horizontal edges of the first, second and third vertical rectangular panels and cooperating with these panels to define a horizontal recess that removably engages one of the horizontal structural members. The frame assembly also includes a vertical portion inwardly disposed from the free vertical edges of the first rectangular panels and cooperates therewith to define a vertical recess in which one of the vertical structural members is disposed. The wall structure is removably secured to the vertical and horizontal structural members previously mentioned by nails, screws or the like. When the wall structure is so secured to the vertical and horizontal structural member, it is held in a rigid and fixed position relative to the wall of the building most adjacent thereto and the floor of the building on which the horizontal structural member to which it is secured rests. The wall structure as previously mentioned is prefabricated and includes a first elongate vertically extending member secured to the first rectangular panel of the first side wall. Also, the first rectangular member of the first side wall supports an elongate electrically energized light, preferably a fluorescent light. A second mirror is provided that extends between the pair of wall structures and is adjacently disposed to the wall of the building most adjacent the pair of wall structures, with the second mirror preferably at least partially supported by the pair of wall structures although it may also be secured to the wall of the building most adjacent thereto. Each of the wall structures includes a first movable drawer in the second panel of the first side wall, which drawer removably holds accessories used by the beauty operator, but these accessories being concealed when the drawer is in a closed position. A second movable drawer is situated in the third panel of the first side wall and is used to removably hold an electrically operated hair dryer, hair curling irons, and the like.

A third movable drawer is provided in the wall structure at a convenient location therein, for receiving soiled linen. Each of the wall structures includes a number of receptacles that extend downwardly from an upper horizontal surface thereof, and these receptacles serving as wells to removably support bottles of liquid such as lotion used by the beauty operator. Each of the wall structures includes a number of electric outlets supported in convenient space relationship on the first side wall thereof. The prefabricated wall structure includes an electric circuit for supplying electric power to the light previously mentioned, as well as to the outlet to which the electric blower, electric irons and the like will be connected. After wall structures have been removably secured to the horizontal and vertical structural members as above described to provide any desired number of confined spaces, in which beauty operators may operate, the wall structures may be used for their intended purpose so long as the lease on the building continues, but at the end of the lease or when the owner of the business desires to move, the wall structures are simply and easily removed from the engaging and horizontal structural members. After such disengagement, the wall structures may be moved as an integral unit to a new location, and installed therein in the same easy and convenient manner as previously described in connection with vertical and horizontal structural members secured to the walls and floor of the new building.

BRIEF DESCRIPTION OF THE DRAWING

FIG. 1 is a perspective view of a pair of the wall structures disposed in a building to define a confined space therebetween in which a chair for a patron may be disposed and on which the beauty operations may be carried out by an operator, with the accessories used by the operator being concealed until use within the confines of the wall structure;

FIG. 2 is a perspective view of a portion of a wall of a building and a floor of the building, with a vertical structural member secured to the wall and a horizontal structural member secured to the floor, with both structural members lying in the same vertical plane;

FIG. 3 is a fragmentary vertical cross-sectional view of an outer end portion of the wall structure taken on the line 3—3 of FIG. 1; and FIG. 4 is a top plan view of a building in which a number of the wall structures are disposed in pairs to define a number of confined spaces in which beauty operators may conduct their operations on patrons.

DESCRIPTION OF THE PREFERRED EMBODIMENT

The wall structure A and A' of the present invention are used in pairs to define a confined space therebetween in which a patron (not shown) may be disposed for beauty work to be performed on the patron by an operator (not shown). Inasmuch as the second wall structure of each pair is identical in construction to the first wall structure A, only the wall structure A will be described in detail. When a building F as shown in FIG. 4 is desired to be converted to a beauty salon, a number of spaced vertically extending structural members B as shown in FIG. 2 are secured to the walls D thereof, and a number of horizontal structural members C are secured to the floor E of the building to lie in the same vertical plane as the vertical structural members and extend outwardly therefrom. Each of the vertical structural members B and the horizontal structural members C associated therewith is used as an anchor or mounting means for one of the wall structures A to removably secure the latter in a fixed position within the confines of the building F. Each pair of first wall structures A and second wall structures A' cooperate to define a confined space therebetween as shown in FIG. 1.

Each of the wall structures A includes a first side wall 10 and second side wall 12 that are parallel to one another and laterally separated therefrom by a hollow frame 14, to which the first and second side walls are secured by conventional means such as nails, screws, or the like. Each of the frames 14 includes an assembly of elements that cooperate to define a first horizontal surface **14*a*, second horizontal surface 14*b*, and third horizontal surface 14*c* as may best be seen in FIG. 1 that are of decreasing elevation. The frame assembly 14 also defines a forward vertical surface 14*b* and a lower horizontal portion 14*e* that is upwardly disposed from the lower horizontal edges of the side walls 10 and 12 and cooperates with the side wall to define a horizontal recess. The horizontal recess 16 as may best be seen in FIG. 3 is occupied by the horizontal structural member C. The frame assembly 14 also includes a rearward vertical portion 14*f* that is inwardly disposed from the rearward free edges of the first and second side walls 10 and 12, and cooperate therewith to define a vertically extending recess 18 that engages the vertical structural member B operatively associated with the horizontal structural member C shown in FIG. 1. The first and second side walls 10 and 12 are secured to the horizontal structural member C and vertical member B by nails 20** or like fastening means.

The first side wall 10 of the first side wall structure A includes a first rectangular vertically extending panel portion **10*a*, a second rectangular portion 10*b* of less height than the first panel portion, and a third panel portion 10*c* of still less height than the second panel portion 10*b*. A first elongate rectangular mirror 22 is provided that is secured to the first panel portion 10*a* of the first side wall 10 as may be seen in FIG. 1, and this first panel portion also removably supporting a vertically extending fluorescent light 24 adjacent to the wall D of the building. A first pivotally supported drawer 26 is supported from the panel portion 10*b* as may be seen in FIG. 1, which drawer may be used to store beauty operator's accessories in a concealed position until such accessories are needed. The second panel 10*b* as may be seen in FIG. 1 also has a cupboard formed therein in which the interior of the cupboard is concealed by pivotally supported doors 27. A second pivotally supported door 28 is mounted on the third panel portion 10*c* as shown in FIG. 1, and serves for the storage of an electrically operated hair dryer (not shown) as well as curling irons (not shown) which are held in the drawer in appropriate side openings 28*a* and 28*b* therein. A second cupboard is also provided inwardly from the third panel portion 10*c*, with interior of this cupboard being concealed by hinged doors 29. A third pivotally supported drawer 30 is formed in the outermost portion of the wall structure A and is used to receive soiled linen or the like. The second horizontal surface 14*b* as shown in FIG. 1 serves as a support for a pair of adjustable spotlights 32. The third surface 14*c* has a number of openings therein that serve as the upper portions of receptacles 33, which receptacles serve as wells for the positioning of bottles of liquid used by the beauty operator (not shown). The third surface 14*c* also serves as a mounting to hold a number of pivotally supported trays 36 therefrom by conventional means. The first and second wall structures A and A' serve to support a transversely extending mirror 36 therebetween, which mirror includes a first portion 36*a* that is disposed in a parallel abutting position relative to the wall D and a second portion 36*b* that is angled relative to the wall D. The wall structure A, as can be seen in FIG. 1, includes an electric connector 38 from which an electric circuit extends to energize the light 24 and light 32 as well as outlets for the hair dryer and hair curling irons and power to the electric inlet 38 being supplied by a prong connector 40 through which electric current flows from a domestic source thereof through conductors 42. The use and operation of the first and second wall structures A and A′ to define a space within a building in which a beauty operator can provide his services has been explained previously in detail and need not be repeated. When the wall structures A and A′ are desired to be removed from the building F, the fastening means 20** are disengaged from the horizontal structural member C and vertical structural member D and the wall structures A and A′ removed from the building F and transported to a new desired location.

What is claimed is:

1. In combination with a building that includes a floor and a plurality of walls extending upwardly therefrom in which the business of a beauty salon is conducted, a plurality of longitudinally spaced vertical structural members secured to at least one of said walls and a plurality of longitudinally spaced horizontal structural members secured to said floor and lying in the same vertical plane as said vertical structural members, a plurality of pairs of prefabricated wall structures that removably engage a pair of said vertical and horizontal structual members to be supported thereby in vertical positions and normal to the one of said walls most adjacent thereto, said pair of wall structures when so disposed defining a space therebetween in which a chair for the support of a patron during the time that work is being performed on said patron by a beauty operator, each of said wall structures including:

a. first and second laterally spaced, parallel side walls, each of said side walls defining first, second and third rectangular panels of decreasing height;

b. a hollow frame assembly disposed between said first and second side walls and rigidly secured thereto, said frame assembly defining first, second and third horizontal surfaces that are flush with the upper horizontal surfaces of said first, second and third panels, a forward vertical surface flush with forward vertical edges of said first and second side wall, a horizontal portion upwardly disposed from lower horizontal edges of said first, second, and third vertical rectangular panels and cooperating therewith to define a horizontal recess that removably engages said horizontal recess that removably engages said horizontal structual member, and a vertical portion inwardly disposed from the free vertical edges of said first rectangular panels and cooperating therewith to define a vertical recess in which said vertical structual member is disposed;

c. first means for removably securing said wall structure to said vertical and horizontal structural members when the latter are disposed within said vertical and horizontal recesses, said first means cooperating with said vertical and horizontal structural members to maintain said wall structure at a fixed position relative to said floor and said wall most adjacent said wall structure;

d. a first mirror secured to said first rectangular panel of said first side wall;

e. electrically energized light means secured to said first rectangular end of said first side wall and adjacently disposed to said mirror;

f. a second mirror that extends between said pair of wall structures and is adjacently disposed to said wall of said building most adjacent said pair of wall structures;

g. first movable drawer means in said second panel of said first side wall for removably holding accessories of said beauty operator;

h. second movable drawer means in said third panel of said first side wall for removably holding an electrically operated hair dryer and hair curling irons;

i. third movable drawer means in said wall structure for receiving soiled linens;

j. a plurality of spaced receptacles that extend downwardly from said third horizontal surface that serve as wells to removably support bottles of liquid used by said beauty operator;

k. a plurality of electric outlets supported in spaced relationship on said wall structure; and l. an electric circuit for supplying electric power to said light means and said outlets.

* * * * *